United States Patent [19]

Scampini

[11] Patent Number: 4,701,108

[45] Date of Patent: Oct. 20, 1987

[54] VARIABLE VOLUME EJECTOR WITH MOTIVE FLUID PULSER

[76] Inventor: Daniel Scampini, 64B Woodhollow, Twin Lakes Apts., Clifton Park, N.Y. 12065

[21] Appl. No.: 864,308

[22] Filed: May 19, 1986

Related U.S. Application Data

[63] Continuation-in-part of Ser. No. 732,657, May 10, 1985, abandoned.

[51] Int. Cl.[4] ..... F04F 11/00; F04F 5/48

[52] U.S. Cl. ..... 417/104; 417/187

[58] Field of Search ..... 417/54, 65, 92, 104, 417/187; 137/625.31

[56] References Cited

U.S. PATENT DOCUMENTS

| | | | |
|---|---|---|---|
| 864,969 | 9/1907 | Kenerson et al. | 417/187 X |
| 1,195,691 | 8/1916 | Lafore | 417/187 X |
| 1,469,364 | 10/1923 | McKerahan | 417/104 X |
| 2,248,073 | 7/1941 | Gage | 417/187 X |
| 2,617,582 | 11/1952 | Beall | 417/104 |
| 3,473,736 | 10/1969 | Heitzman | 137/625.31 |
| 4,201,049 | 5/1980 | Tobber | 417/92 X |

FOREIGN PATENT DOCUMENTS

| | | | |
|---|---|---|---|
| 229856 | 1/1911 | Fed. Rep. of Germany | 417/187 |
| 899701 | 12/1953 | Fed. Rep. of Germany | 417/104 |
| 1200145 | 6/1959 | France | 417/94 |

*Primary Examiner*—Carlton R. Croyle
*Assistant Examiner*—Paul F. Neils
*Attorney, Agent, or Firm*—Schmeiser, Morelle & Watts

[57] ABSTRACT

A method and apparatus for ejecting fluids through use of a high pressure liquid motive fluid by forming hydraulic slugs from said motive fluid and conducting it through conventional ejection mechanisms, entraining a fluid which is to be ejected and depositing it into containment of user's choice. A pulser apparatus is employed which embodies the concept of abruptly starting and stopping high pressure motive flow, contemporaneously constricting the downstream flow through use of either inlet or instream interruption means, and entraining quanta of fluid to be ejected, said entrainment being the urging of said discrete quanta by the momentum of a series of hydraulic slugs formed by the aforementioned method.

2 Claims, 6 Drawing Figures

Fig 1A
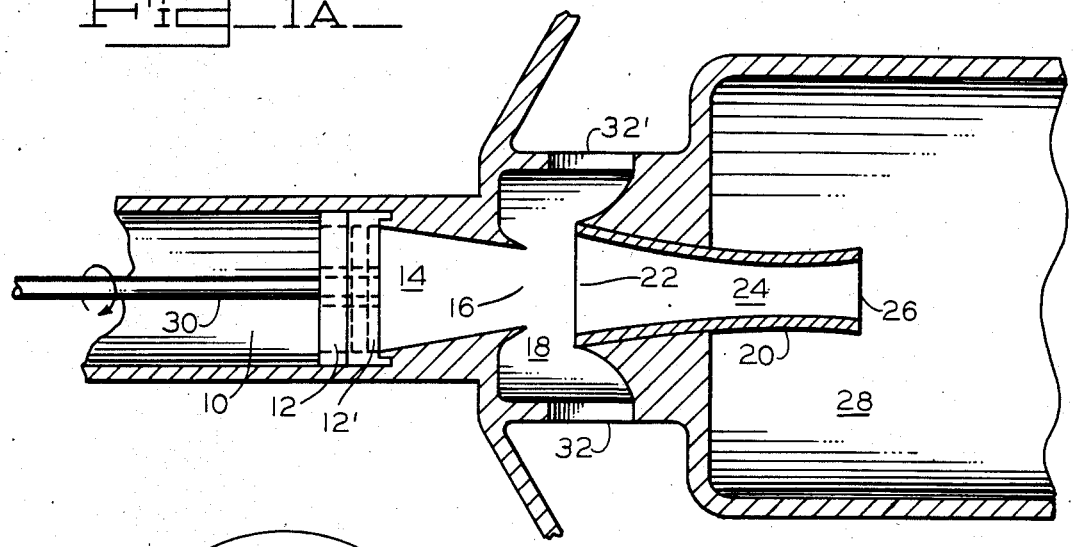
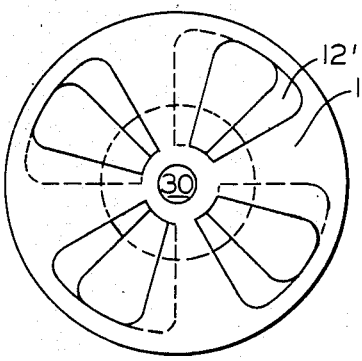
Fig 1B
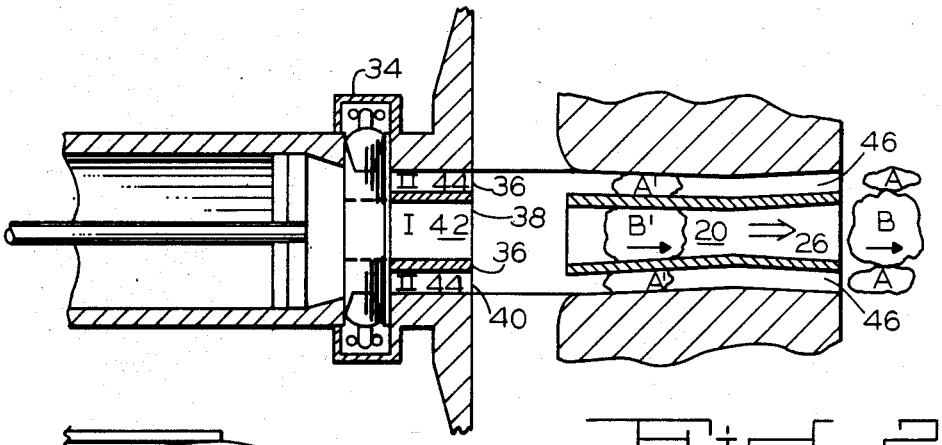
Fig 2A
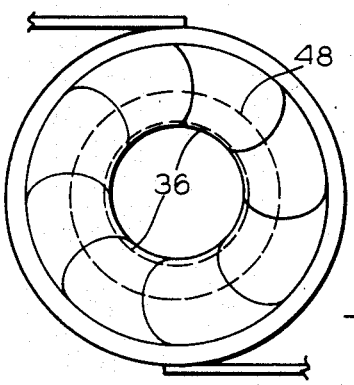
Fig 2B

VARIABLE VOLUME EJECTOR WITH MOTIVE FLUID PULSER

CROSS REFERENCE TO RELATED APPLICATIONS

This application is a continuation-in-part of an earlier filed co-pending application by the same inventor, Ser. No. 732,657, filed May 10, 1985 now abandoned, entitled variable volume Ejector.

FIELD OF THE INVENTION

This invention relates to fluid ejectors generally and, in particular, to variable volume ejectors in which the variation in ejected volume of a fluid is controlled by varying the flowrate of the motive fluid. The design is unique in that the flow of the motive fluid is further controlled by the use of a fluid pulsing mechanism.

BACKGROUND AND OBJECTS OF THE INVENTION

Ejectors have been in use for many years, sharing the basic functions of exhausting fluids or evacuating fluid-filled containers. They are known generally as ejectors or jet pumps and operate on the principle of one fluid (a motive fluid) entraining a second fluid. The functions being basically the same, the distinction within the art lies primarily in the design and construction of these ejectors or jet pumps.

All ejectors have three common features: an inlet, a port which allows the induction of the motive or operating medium (fluid) under pressure; suction or quasi-suction, a functional aspect which begins the entrainment process; and discharge, the stage wherein motive fluid energy is imparted to the fluid which is to be exhausted or pumped.

Pressurized pumping medium, hereinafter known as motive fluid, enters the inlet and travels through a nozzle or constricting aperture into the suction chamber. The purpose of the nozzle is to condition the motive fluid, generally by converting the pressure of the motive fluid into a high velocity stream which passes from the exit side of the inlet nozzle immediately to the inlet side of a discharge or ejector tube.

Ejecting or pumping action begins when an entrainment fluid in the suction chamber is captured or entrained by the high velocity stream emerging from the inlet's downstream nozzle. The venturi phenomenon effects lowering of the pressure in the suction chamber. The resulting action causes the entrainment fluid in the suction chamber to flow towards the discharge or ejector tube outlet urged by, and with, the motive fluid.

In the general ejector case, the entrained fluid from the suction chamber mixes with the motive fluid and acquires part of its energy in the downstream, discharge tube section. Normally, a diffuser section is provided adjacent and downstream of the discharge tube. Part of the velocity of the motive-entrained fluid mixture is converted to a pressure greater than the suction pressure, but lower than the motive fluid pressure. It is finally discharged at the diffuser exit port.

The amount of entrainment fluid which can be entrained by the motive fluid is dependent upon the amount of suction produced in the suction chamber from the discharge of the motive fluid through the suction chamber. Limitations on conventional ejector efficiency occur when large quantities of entrained fluid are elicited from a relatively small ejector unit. Because the vacuum produced by Venturi effect in these units is very limited in the amount of entrainment fluid which it may capture, the only reasonable way to increase the entrainment capacity of an ejector is to increase its size. Conventional ejectors possessing a single inlet nozzle and discharge nozzle are thus limited in the range of fluid flow volume that may be expected.

Compounding the disadvantageous low volume capability of most ejectors is their inherent lack of ability to compress the entrained fluid to high pressures. This derives from the fact that entrainment is essentially a boundary layer phenomenon. The motive fluid captures the entrained fluid between its boundary and the walls of the discharge tube. There is generally a mixture of the two fluids as energy is transferred from the motive to the entrained. This phenomenon is dependent upon many factors, not the least of which is solubility of the entrained fluid in the motive fluid or vice versa. In fact, if the two fluids are immiscible, a great deal of the efficiency of the ejector is lost. To act as a high pressure compressor, as most pumps are capable, the ejector or jet pump art obviously depart from the conventional entrainment principles that are employed today.

It is therefore an object of this invention to provide a variable volume ejector which can function relatively free from the limitations of size.

It is also an object of this invention to provide a variable volume ejector which will provide efficient operation over a wide range of fluid flows.

It is another object of this invention to provide an ejector which may be used to pump gaseous fluids as well as liquid fluids.

It is yet another object of this invention to provide an ejector which is capable of entraining a greater quantity of fluid than do conventional ejectors of comparable size.

It is a major object of this invention to make use of a principles of ejection by positive displacement means rather than conventional entrainment.

Finally, it is an object of this invention to provide means by which the aforesaid positive displacement (of entrained fluids) can be achieved; such a method contemplates the urging of entrained fluid by use of the momentum and confinement of hydraulic slugs rather than boundary layer entrainment.

I have described the operation of certain conventional fluid pumps—jet pumps and ejectors—in order to set out the standard of current art. I shall describe my invention hereinafter in terms of specified embodiments which shall be set forth in general form. The objects of the invention, having been set forth in part herein, will be readily seen or may be learned by practice with the invention.

SUMMARY OF THE INVENTION

The present invention accomplishes the above objects by providing an ejector inlet having motive fluid pulsing means so that the working or motive fluid is formed into piston shapes, termed hydraulic slugs.

The hydraulic slugs formed in the ejector inlet are passed then through a variable flow control actuator which, by changing inlet exit orifice cross sectional area, varies the diameter of the hydraulic slug which is allowed to pass therethrough. The flow control actuator means used in the preferred embodiment comprise one or more iris valves. Immediately downstream of the flow control actuator means is an extension of the inlet exit orifice, comprising two or more concentric cylindrical passageways which terminate in the suction chamber with constrictive cross-sectional areas termed concentric nozzles.

The suction chamber, in the preferred embodiment, is termed so because the fluid pressure therein is much lower than the motive fluid pressure which, during operation, is continuously entering the suction chamber from the inlet exit port nozzle(s). Means are provided for regulating the flow of entrained fluid being drawn into the suction chamber by either its lower relative pressure or from some pressurizing means external to the suction chamber which is to provide that entrainment fluid. For certain applications, backflow prevention means are also provided with or in lieu of these entrainment fluid flow control means.

The discharge mechanism of the variable volume ejector comprises one or more concentric cylindrical chambers which are coaxial with the inlet chamber and its exit port nozzles. This coaxial registry is necessary so that the concentric discharge cylinders are aligned with their respective inlet exit port nozzles in order to receive the motive fluid discharges therefrom. Thereafter, the downstream ejection mechanism of this invention resembles the conventional jet pump or ejector.

Of significant importance in the present invention is the fluid pulser provided for forming hydraulic slugs of the motive fluid. This inventional object has been achieved by introducing first a high pressure motive fluid into the inlet means, thereafter providing valving which has the capability of opening abruptly, i.e., near-instantaneously, to allow the highly pressurized motive fluid to fill the inlet chamber. Subsequently, the inlet chamber is constricted either immediately prior to, or concurrent with, its registry with the variable flow controlled actuating means. It is the combination of these three factors: introduction of high pressure motive fluid; near-instantaneous valving; and constriction, which, novel in their combination relative to ejectors and fluid pumps, cooperate to form the hydraulic slugs. The slugs, in turn, dissipate part of their momentum by pushing quanta of fluid (entrained) through the ejector tube(s).

Finally, other apparatus may be utilized in the varied embodiments of this ejector such as backflow preventers in conjunction with the diffuser portions, as well as baffling and state-of-the-art fluid separators.

In the first actual reduction to practice, I was able to achieve initial success using water as a motive fluid which had been pressurized to 25 psi with an electric motor pump. What I shall later describe as a cylindrical pulser, composed of brass, a plexi-glass separation chamber and galvanized steel tubing were also employed. The entrained fluid was air which was pumped, and thus compressed, into an enclosed separation chamber, to 5 psi.

It will be understood that the foregoing general description and the following detailed description, as well, are illustrative or the invention but are not restrictive thereof. Thus, while I relied on a pulser mechanism constructed within the ejector inlet chamber, those versed in the particular art will recognize that I have merely chosen this method to embody the concept of forming hydraulic slugs, as a motive force, in order to operate an ejector on the principle of positive displacement rather than the conventional boundary layer entrainment of traditional ejectors and jet pumps.

The accompanying drawings, referred to herein and made a part hereof, illustrate preferred embodiments of the invention, and together with the description, serve to explain the principles of my invention.

BRIEF DESCRIPTION OF THE DRAWINGS

Of the drawings;

FIG. 1 is a bi-part illustration depicting, as FIG. 1A and in cross section, a constant volume ejector with motive fluid pulsing means and, in FIG. 1B, an elevational view of the pulser mechanism;

FIG. 2 is a bi-part illustration depicting, as FIG. 2A, a cross-sectional representation of a variable volume fluid ejector with motive fluid pulsing means and, in FIG. 2B, a front elevational view of a fluid flow control iris regulator in partial first stage open mode;

DETAILED DESCRIPTION OF THE PREFERRED EMBODIMENTS

Figure 3:
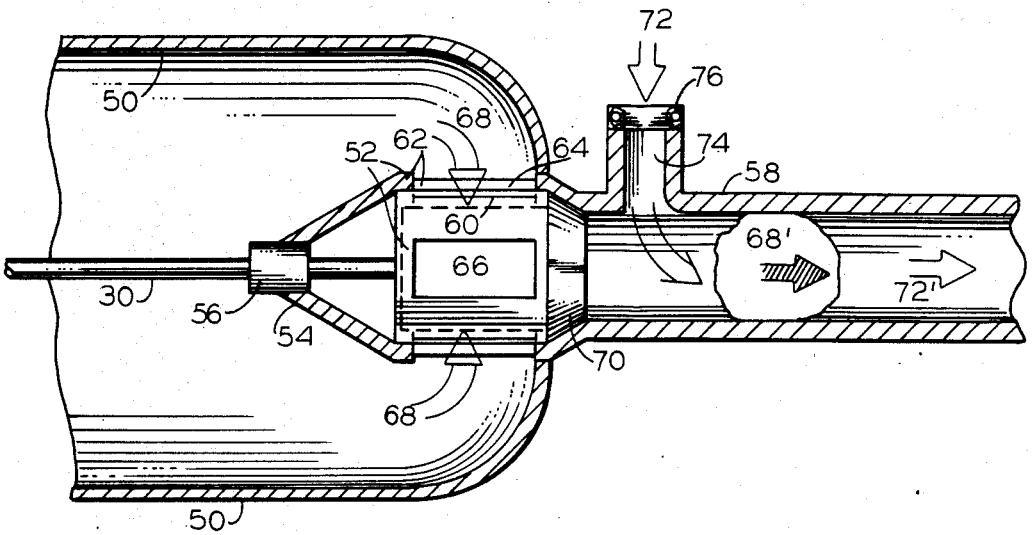
FIG. 3 is a cross-sectional view of a constant volume fluid ejector utilizing cylinder-within-cylinder motive fluid pulse actuation means.
Figure 4:
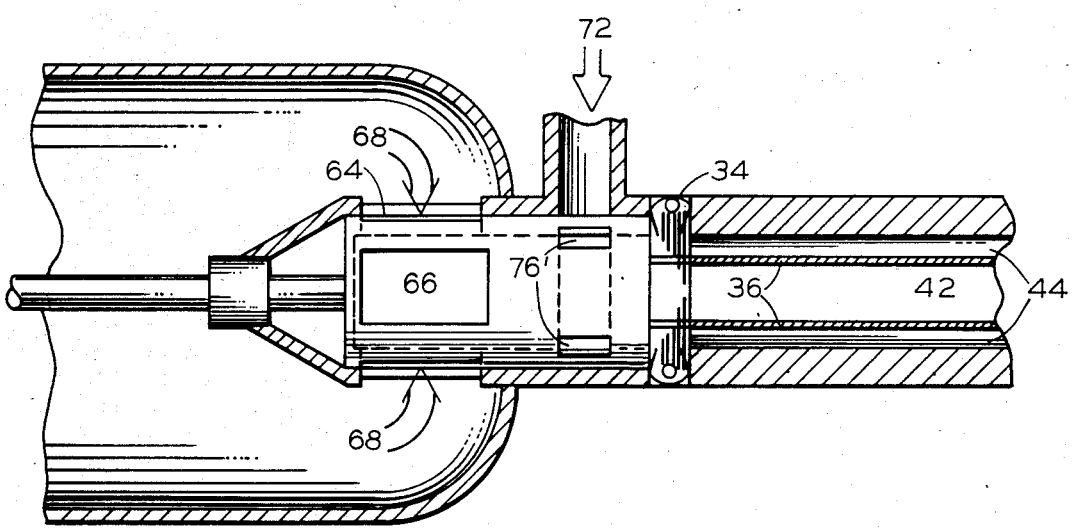
FIG. 4 is a variable volume ejector utilizing pulsing mechanisms of FIG. 3.

Referring to FIGS. 1–4 of the accompanying drawings, there are illustrated ejector mechanisms capable of constant volume operation (FIGS. 1 and 3), and variable volume operation (FIGS. 2 and 4). It should also be understood that the principle of positively displacing the entrained fluid by means of hydraulic slugs is the principle mode of operation and, consequently, all embodiments contain this mechanism.

As preferably embodied in FIG. 1A, the constant volume pulsing ejector comprises an inlet area 10, a pulser 12, slug formation chamber 14, inlet area exit port 16, suction chamber 18, and ejector section 20. The ejector section 20 comprises a venturi-type inlet 22, what is commonly referred to as the parallel section 24 and a diffuser-discharge port 26. Illustrated in this embodiment only is the ejector portion 20, passing from the suction chamber 18 through, into and terminating within the fluid separator means 28. The fluid separator means 28 functions as both a means for separating the entrained fluid from the motive fluid and a confinement means, thus allowing compression of the entrained fluid.

FIG. 1B, depicting one form of a pulser mechanism, illustrates the superposition of two similarly apertured plates 12, 12', which are positioned in the inlet throat of the ejector as depicted in FIG. 1A. The downstream plate 12' is fixed, while the upstream plate 12 is caused to rapidly rotate by power means applied to shaft 30. In FIG. 1B, rotating plate 12, the upstream plate, is depicted approximately one third of the way through a closing cycle. Note that downstream plate 12', denoted by the shaded area, is visible through approximately one third of the upstream plates' apertures. As mentioned earlier, downstream plate 12' is fixed while upstream plate 12 is motivated by power means coupled through shaft 30. The motive means for driving shaft 30 are not herein depicted but those versed in the art will readily acknowledge that such motive means may encompass those obtained by any rotary drive mechanism available today. As the applicant pointed out in the summary of this invention, he gained initial success using an electric motor to drive said shaft.

Referring once again to FIG. 1A, there is also illustrated, contiguous to suction chamber 18, a number of inlet ports 32, 32' which may be fitted with entrained fluid flow control and/or backflow preventer valves. (not herein depicted).

I should like now, to briefly explain with reference to FIG. 1, how I have achieved ejection and compression of a gaseous fluid by means of a highly pressurized motive fluid, with such apparatus. A highly pressurized liquid fluid (water) was introduced into the ejector apparatus via the inlet chamber 10. With pulser plate 12, 12' superimposed in an open position (to allow free flow from inlet chamber 10 to its downstream exit chamber 14) by holding upstream pulser plate 12 rigid through shaft actuation means 30, the motive fluid was initially allowed to pass out of exit port nozzle 16 through the suction chamber 18 and into ejector means 20. This created a low pressure chamber which was immediately filled by gaseous fluid (air) passing into suction chamber 18 through induction port 32, 32'. The creation of the Venturi effect allowed the air to be entrained with the water and carried into separator 28. As air pressure began to build slightly within the separator (which was not evacuated), back pressure soon caused the ejector to fail. Motive fluid began to exit at induction ports 32, 32'.

Switching to the operative mode, I increased the motive fluid pressure, while simultaneously applying motive means, that is, connection of an electric motor, to pulser plate actuator shaft 30. The effect was as anticipated; with each opening, and corresponding closing, of the pulser (plates 12, 12'), downstream exit chamber 14 was abruptly filled at high pressure with the motive fluid. The slight constriction afforded by the geometry of the downstream exit chamber 14 and its nozzle means 16 are required to compensate for the sudden loss of cross-sectional area as the motive fluid transitions the pulser plate(s). This construction literally forms the hydraulic slug. The head of the slug presents a "wall of water" as it begins to transition the suction chamber 18 space between exit nozzle 16 and ejector tube intake 22. Gaseous fluid which has entered through induction port 32, 32' has filled the void of suction chamber 18 as well as the ejector tube 20. Meanwhile, the pulser plates have closed and the tube of water exiting chamber 14 has the physical appearances of a liquid piston. The hydraulic slug or liquid piston rams the inlet portion 22 of ejector tube 20, forcing the gaseous fluid therein through the tube into the separator-compression chamber 28. As described earlier in this specification, diffuser means 26 assists in the separation of motive fluid from entrained fluid; however, as pointed out, my invention does not utilize the traditional entrainment means, but rather employs a positive displacement technique. Therefore, it can be seen that the conventional diffuser has limited utility in this application. The conventional diffuser means can be replaced by a backflow climinator or check valve apparatus, which would be more functional in certain applications, e.g., low rate of operation.

Referring now to FIG. 2, specifically FIG. 2A, I have depicted the invention of FIG. 1 in its variable volume configuration. This is done by what I term "multi-coring" the hydraulic slug prior to its transition through the suction chamber. This is done by interposing, immediately downstream of the constricting inlet exit chamber 14, an iris valve 34. Immediately downstream of the iris valve, the remaining portion of chamber 14 is concentrically partitioned by emplacement, within the stream, of one or more concentric tubes; here, concentric tube 36 forms the partition with corresponding nozzles 38 and 40 for chambers labeled Stage I 42 and Stage II 44, respectively. In this embodiment, the hydraulic slug or piston is cylindrically bifurcated and the slug entering the transitional area in suction chamber 18 appears to be a cylindrical toroid surrounding a solid cylinder. Thereafter, operation is essentially the same as in FIG. 1.

Under initial operating conditions, iris valve 34 is at the position depicted in FIG. 2B, that is, set at its first stage opening position thereby covering toroidial chamber 44. As can readily be seen, the hydraulic slug formed would traverse only section 42, transitioning the suction chamber and entering ejector tube 20. I have illustrated hydraulic slugs B, B' in order to detail this configuration. It is important to note that, in this configuration, backflow preventer means are necessitated at ejector exit ports.

When greater volume is desired, iris valve 34 is opened to its second stage position, denoted in FIG. 2B, by phantom outline 48. At this time, both chambers 42 and 44 shape the slug configuration described above, and the resultant slugs B and A would be realized. Thus, there is presented herein, the description of a variable volume ejector which has motive fluid pulsing means for the formation of hydraulic slugs or pistons. It should also be understood that the technique for achieving flow variation may be employed to further increase such variation. One can conceive of a series of concentric slug separators (referred to earlier as a "bifurcator") with corresponding concentric ejector tubes. The iris valve regulating means would then be constructed to open in one, two, . . . x stages. Of course, as mentioned above, check means or back flow eliminator means must be utilized at various ejector tube exhaust ports if the invention is to be employed as a ejector-compressor. This reasonably follows since, in such an embodiment, if one were to use only first stage operation, it would be necessary to curtail backflow through the other "one plus" stages. It is also conceivable that, in multi-chamber (variable) ejector operation, ejector exit port take-offs could be placed at differing locations along the center flow lines. For example, given the two exit ports 26 and 46, depicted in FIGS. 2A, I have contemplated a separator-within-separator configuration; the inner would receive ejecta from tube 20 and the outer would receive ejecta from tube 46.

In FIG. 3, I have introduced a pulsing means which can be used without apparent downstream constriction and still form the desired piston or hydraulic slug 68' of motive fluid. Referring particularly now to FIG. 3, there is illustrated a high pressure motive fluid container 50 enveloping the pulser section 52. Pulser actuation shaft means 30 remains essentially unchanged in this embodiment. As a practical matter, as I have noted earlier, an electric motor may be used to provide shaft 30 drive means. The framework 54, including bearing 56 may be constructed integrally with ejector tube 58 proper, or can be fitted to the high pressure motive reservoir 50.

In this embodiment, the pulser 52 comprises a cylinder 60 driven by shaft means 30 and residing within cylindrical housing end 62 of the ejector 58. The pulser inner cylinder 60 and the outer cylindrical ejector end 62 are placed wholly within the envelope 50, also referred to as the high pressure motive fluid reservoir. Both of these cylindrical geometrics 60, 62 are apertured; here, the outside cylindrical body apertures 64 and the inside rotational cylinder apertures 66 are positioned 90 degrees from each other. In operation, inner cylinder 60 is caused to rotate and, as inside apertures 66 align with outside apertures 64, high pressure motive fluid 68 would enter the ejector's apparent inlet side. Constrictive means 70 induce the formation of a hydraulic slug. It must be realized, however, that although it is a design of this embodiment, discrete constriction is not necessary to the formation of the hydraulic slug. Notably, in this embodiment, if apertures 64 and 66 have a total cross-sectional area exceeding the cross sectional area of ejector tube 58, constriction will have effectively taken place. Therefore, it must be taught that required constriction means relative constriction, i.e., cross-sectional area out should be somewhat less than cross-sectional area in.

When formed, the hydraulic slug will traverse ejector tube 58. The void 72' between slugs is filled by entrainment fluid 72 entering at induction port 74 through backflow preventer and control valve 76. One familiar with the operation of ejectors and jet pumps will realize that the entrainment fluid induction method, as well as the suction chambers of both of the herein described embodiments, though appearing diagrammatically different, are physically the same embodiment. This fact may be seen more clearly in FIG. 4.

FIG. 4, inculcating the method and mechanics of the variable volume ejector shown in FIG. 2A, contains an innovation designed to eliminate backflow preventer means 76 of FIG. 3. The apparatus downstream of air induction ports 76' operates on the same principle (after hydraulic slug formation) as iris valve 34 and chambers 42 and 44 of FIG. 2A. Therefore, the inlet-pulsing means embodied herein will be discussed.

Attention is now called to FIG. 4 at the point of induction of motive fluid 68. The familiar cylinder-within-cylindrical chamber pulser is used in a slightly different configuration. Inlet apertures 64, 66 are larger than those of FIG. 3. This is because the constriction 70 of FIG. 3 has been eliminated so that a rotating inner pulser cylinder 60 may employ induction ports 76 and terminate at iris valve 34 while maintaining a consistent cross-sectional area with stage 11 ejector tube chambers 42/44. Although a discrete constriction has not been employed, nonetheless constricting is effected by using motive fluid intake aperturing having greater cross-sectional area than the downstream inlet-ejector tubing (relative constriction, ibid.)

The latter design alternative may, in fact, be employed in any of the aforementioned embodiments. Suprisingly enough, the theory itself, i.e., use of hydraulic slugs is adaptable to generally all jet pumps and ejectors in use today. The basic principle that is applied is a presentation of a "solid" hydraulic front to a constraining (tubular) chamber, having first filled the chamber with some fluid which is to be ejected or pumped. Analogously, if one were to pass intermittently a flowing jet of water from a high enough pressure source past the mouth of a conventional liquid funnel, that person would observe a series of water slugs or "spurts" (quite well defined), leaving the nozzle end of the funnel. Each slug or spurt would be preceeded by a quantum of entrapped (literally, entrained) air.

It is evident, therefore, that the invention in its broader aspects is not limited to the specific embodiments herein shown and described, but that departures may be made therefrom within the scope of the accompanying claims, without departing from the principles of the invention and without sacrificing its major advantages.

What is claimed:

1. A fluid ejector comprising:

a body having an essentially cylindrical chamber therethrough for the purpose of transporting therethrough a motive fluid and a fluid which is to be ejected and further comprising an inlet chamber having a plurality of opposing apertures, a suction chamber having an induction port and an ejector chamber therein;

a source of high pressure liquid fluid for induction into said inlet chamber said source physically enveloping the apertures of said inlet chamber;

a means contained by said inlet chamber for pulsing said motive fluid prior to its passage into said suction chamber, said means further comprising a rotating cylinder having apertures which periodically align with said apertures of said inlet chamber, whereby said high pressure motive fluid when inducted into said inlet chamber is caused to form hydraulic slugs which travel through said inlet chamber, through said suction chamber and thence into and through said ejector chamber, entering and capturing quanta of fluid to be ejected which enters at said induction port from said suction chamber and, by their momentum, carrying said quanta through said ejector chamber.

2. The invention of claim 1 wherein said pulsing means further comprises a motivated rotating apertured tubular cylinder longitudinally mounted with respect to said body and within said inlet chamber, whereby the apertures of said tubular cylinder are intermittently in and out of registry with the apertures of said inlet chamber and effect induction of said high pressure fluid in a repeated pulsing fashion.

* * * * *